US009706806B2

(12) United States Patent
Van Waes

(10) Patent No.: US 9,706,806 B2
(45) Date of Patent: Jul. 18, 2017

(54) HELMET COVER

(75) Inventor: Sean Van Waes, Antwerp (BE)

(73) Assignee: LAZER SPORT NV (BE)

( * ) Notice: Subject to any disclaimer, the term of this patent is extended or adjusted under 35 U.S.C. 154(b) by 944 days.

(21) Appl. No.: 13/638,893

(22) PCT Filed: Mar. 31, 2011

(86) PCT No.: PCT/EP2011/055021

§ 371 (c)(1),
(2), (4) Date: Mar. 7, 2013

(87) PCT Pub. No.: WO2011/121079

PCT Pub. Date: Oct. 6, 2011

(65) Prior Publication Data

US 2013/0205479 A1 Aug. 15, 2013

(30) Foreign Application Priority Data

Apr. 2, 2010 (EP) ..... 10003682

(51) Int. Cl.

| | |
|---|---|
| ***A42B 1/24*** | (2006.01) |
| ***A42B 7/00*** | (2006.01) |
| ***A63B 71/10*** | (2006.01) |
| ***A42B 3/04*** | (2006.01) |
| ***A42B 3/00*** | (2006.01) |

(52) U.S. Cl.
CPC ..... *A42B 3/0406* (2013.01); *A42B 3/003* (2013.01)

(58) Field of Classification Search
CPC ..... A42B 3/0405; A42B 3/003; A42B 1/006; A42B 1/062; A42B 3/28; A42B 3/0406; A42B 3/04
USPC ..... 2/422, 425, 421, 6.2, 175.3–4
See application file for complete search history.

(56) References Cited

U.S. PATENT DOCUMENTS

| | | | | |
|---|---|---|---|---|
| 4,020,507 | A * | 5/1977 | Morton | A42C 2/007 2/411 |
| 4,937,888 | A | 7/1990 | Straus | |
| 4,996,724 | A * | 3/1991 | Dextrase | A42B 3/066 2/411 |
| 5,525,290 | A | 6/1996 | Carpenter | |
| 6,101,636 | A * | 8/2000 | Williams | A42B 3/0406 2/410 |
| 6,332,228 | B1 * | 12/2001 | Takahara | A42B 3/003 2/422 |
| 6,848,122 | B1 * | 2/2005 | Meeds | A42B 3/003 2/175.6 |
| 7,125,434 | B2 * | 10/2006 | Yavorsky | B01D 39/1623 210/338 |

(Continued)

FOREIGN PATENT DOCUMENTS

| | | |
|---|---|---|
| FR | 2717990 | 10/1995 |
| GB | 2415614 | 1/2006 |

(Continued)

OTHER PUBLICATIONS

International Search Report for PCT/EP2011/055021, Completed by the European Patent Office on Jun. 17, 2011, 3 Pages.

*Primary Examiner* — Khaled Annis
*Assistant Examiner* — Timothy K Trieu
(74) *Attorney, Agent, or Firm* — Workman Nydegger

(57) ABSTRACT

A helmet cover having a dome with an outer edge, having at least two engaging members are provided extending along the outer edge of the dome and a method of advertising using the helmet.

16 Claims, 4 Drawing Sheets

(56) References Cited

U.S. PATENT DOCUMENTS

| | | | | |
|---|---|---|---|---|
| 7,140,049 | B2 * | 11/2006 | Lang-Ree | A42C 2/002 2/412 |
| 8,020,219 | B2 * | 9/2011 | Jacobsen | A42B 3/066 2/421 |
| 8,166,573 | B1 * | 5/2012 | Chung | A42B 3/32 2/411 |
| 2005/0003146 | A1 | 1/2005 | Spath | |
| 2007/0056081 | A1 * | 3/2007 | Aspray | A42B 3/046 2/411 |

FOREIGN PATENT DOCUMENTS

| | | | |
|---|---|---|---|
| JP | S63064732 | U1 | 4/1988 |
| JP | S63069123 | U1 | 5/1988 |
| JP | H04013624 | U | 2/1992 |
| JP | 2002339138 | A | 11/2002 |
| JP | 2003342822 | A | 12/2003 |
| JP | 2005537034 | A | 12/2005 |
| JP | 2007023459 | | 2/2007 |
| JP | 3132412 | U | 6/2007 |
| WO | 9321014 | A1 | 10/1993 |
| WO | 03000483 | A1 | 1/2003 |
| WO | 2007077517 | | 7/2007 |
| WO | 2007077517 | A1 | 7/2007 |

* cited by examiner

HELMET COVER

CROSS-REFERENCE TO RELATED APPLICATION

This application is the U.S. national phase of PCT Appln. No. PCT/EP2011/055021 filed on Mar. 31, 2011, which claims priority to European Patent Application No. 10003682.1 filed on Apr. 2, 2010, the disclosures of which are incorporated in their entirety by reference herein.

FIELD OF THE INVENTION

The present invention concerns a helmet cover.

BACKGROUND OF THE INVENTION

At the one hand, with ever increasing traffic, to see and to been seen is one of the most important safety precautions. Especially for vulnerable road users traveling in close proximity of fast vehicles, such as cyclers, being seen is taught to be very important for avoiding injury risks.

Clearly when cycling between cars, the cyclers head or helmet is noticed first by other road users, and the use of colorful helmets has proven a good auxiliary to be seen by other road users, over and above demands and the flexibility required from the fashion industry. Being seen becomes even more important in weather conditions such as rain or heavy winds, wherein sight is generally more restricted than with clear skies.

On the other hand, it should be equally acknowledged that, in rainy conditions, a classical cycling helmet with through-holes is uncomfortable and inconvenient as the rain wets the cyclers head.

To address the above needs, cyclist helmet covers have been proposed. U.S. Pat. No. 6,332,228 describes a helmet with removable helmet cover having at least two engaging members at the interior of the cover configured to engage in through-holes in the helmet for the fixation of the cover to the helmet.

An inconvenient of the known helmet cover is that due to the dome structure of the helmet and helmet cover, the engaging members of the cover can only be introduced in the through-holes for fixation in one specific manner by first fixing a rear engaging member and subsequently the front engaging member. As a consequence, the helmet cover needs to be removed in a reverse order of movement.

Removing the helmet cover while cycling is therefore difficult as first disengaging the front engaging member will allow air to flow under the helmet cover, thereby lifting the cover and entirely removing the helmet cover from the helmet. In case the cycler has no good grip on the cover, the cover risks to be lost and might hinder and endanger other road users.

Another inconvenient of the known cover is that in a fixed position of the cover, wind tends to flow between the covers edges and the helmet, thereby reducing the aerodynamics of the helmet and creating turbulences at the covers edges resulting in a hindering noise.

It is clear from the above that there remains a demand for optimization of helmet covers, which allows meeting the above needs and drawbacks, especially regarding easy and flexible removal and equally being aerodynamic.

In summary, the present invention meets the general demand for stimulating vulnerable road users such as cyclers to wear helmets for increasing safety, thereby providing easily removable helmet covers with differentiating fashion prints, allows people to easily personalize their helmets, without deteriorating the impact resistance and other safety characteristics of the helmet. Individual designs and adaptability of the helmets outer occurrence stimulates wearing helmets which, in combination with comfortable and safe handling of the helmet with cover, improves overall safety and protection of cyclers.

SUMMARY OF THE INVENTION

The present invention concerns a helmet cover having a dome with an outer edge, characterized in that at least two engaging member are provided extending along the outer edge of the dome, whereby the engaging members consist of a flange extending inwardly in view of the dome.

The engaging members preferably extend along opposite edges of the dome. The width of the different engaging members are preferably equal.

According to a preferred embodiment of the present invention, the dome comprises a front portion and a rear portion and wherein at least a section of the outer edge from both dome portions is free from engaging members.

The cover is preferably manufactured from a single material and can be coated with a with a friction reducing layer.

The cover according to the invention can be provided with graphics that are applied on the dome, and preferably at the inwardly faced surface of the dome.

DESCRIPTION OF A PREFERRED EMBODIMENT

Figure 1:
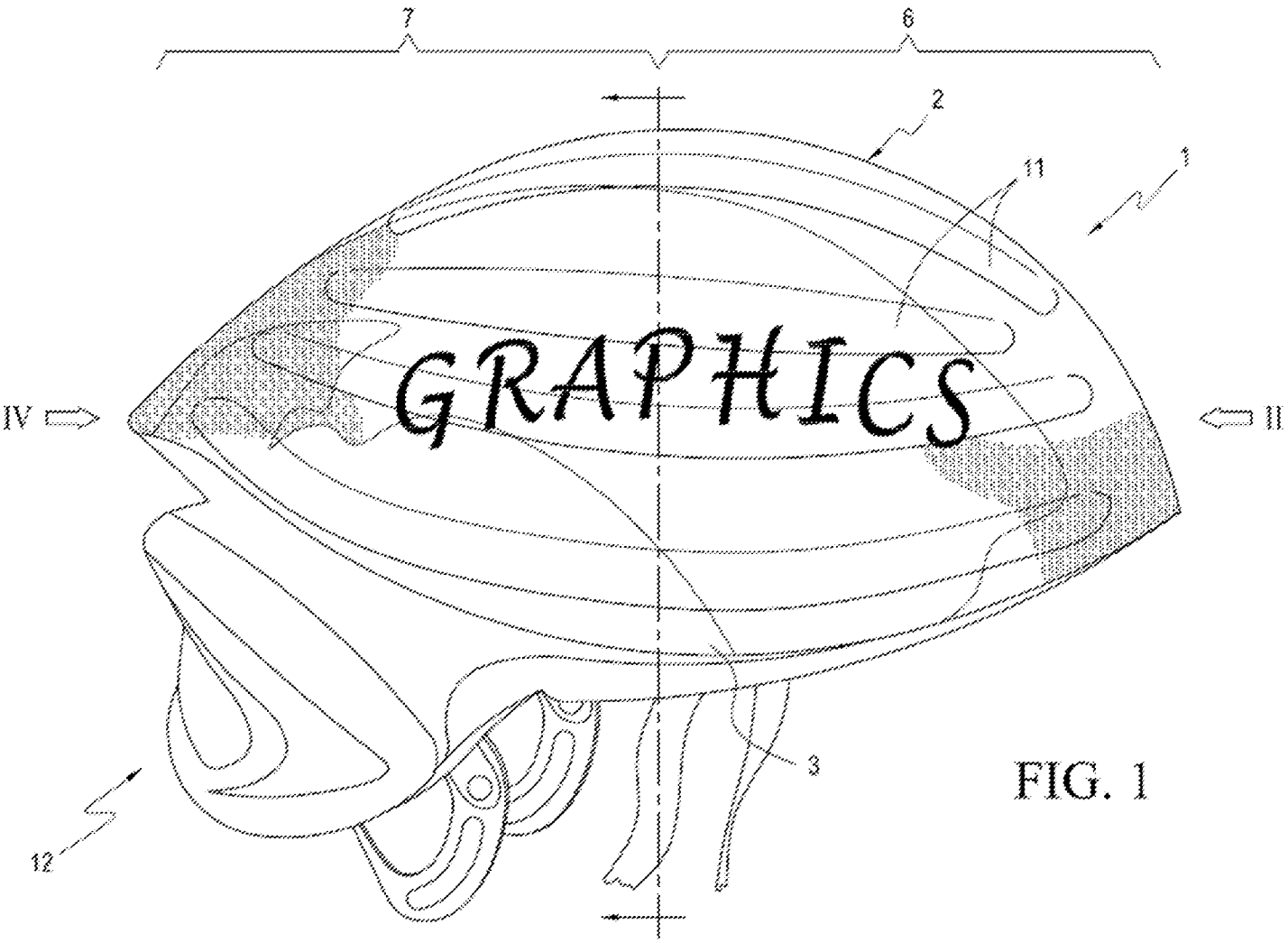
FIG. 1 represents a helmet with helmet cover according to the present invention.

FIG. 1 represents a helmet cover 1 comprising a dome 2 and an outer edge 3, wherein, according to the present invention, at least two engaging members 4 and 5 extend along the outer edge 3.

The dome 2 comprises a front portion 6 that in use is situated at the front of a helmet, i.e. the side of the helmet directed in a forward direction when worn by a person, and a rear portion 7.

Both portions 6 and 7 are preferably provided with at least one engaging member 4, 5 along their respective outer edge 3 and are preferably along at least a section 8, 9 of their respective outer edges free of an engaging member. The engaging members 4, 5 hereby preferably extend along opposite outer edges 3 of the cover.

Figure 2:
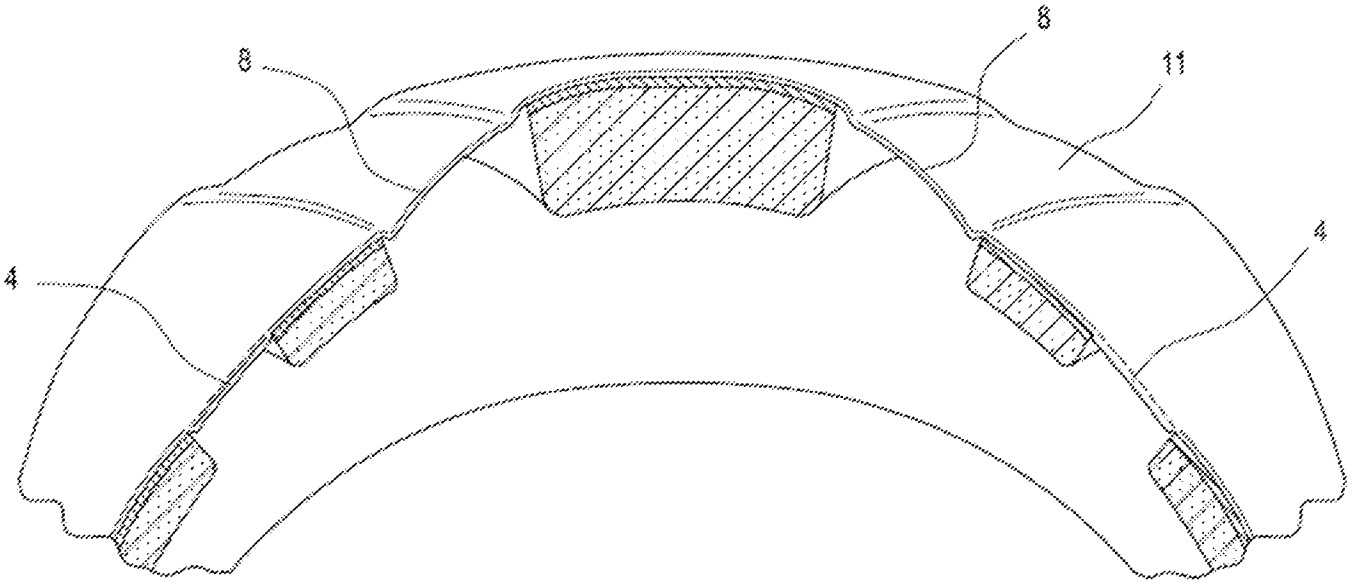
FIG. 2 represents a cross section of a helmet cover according to the present invention.
Figure 3:
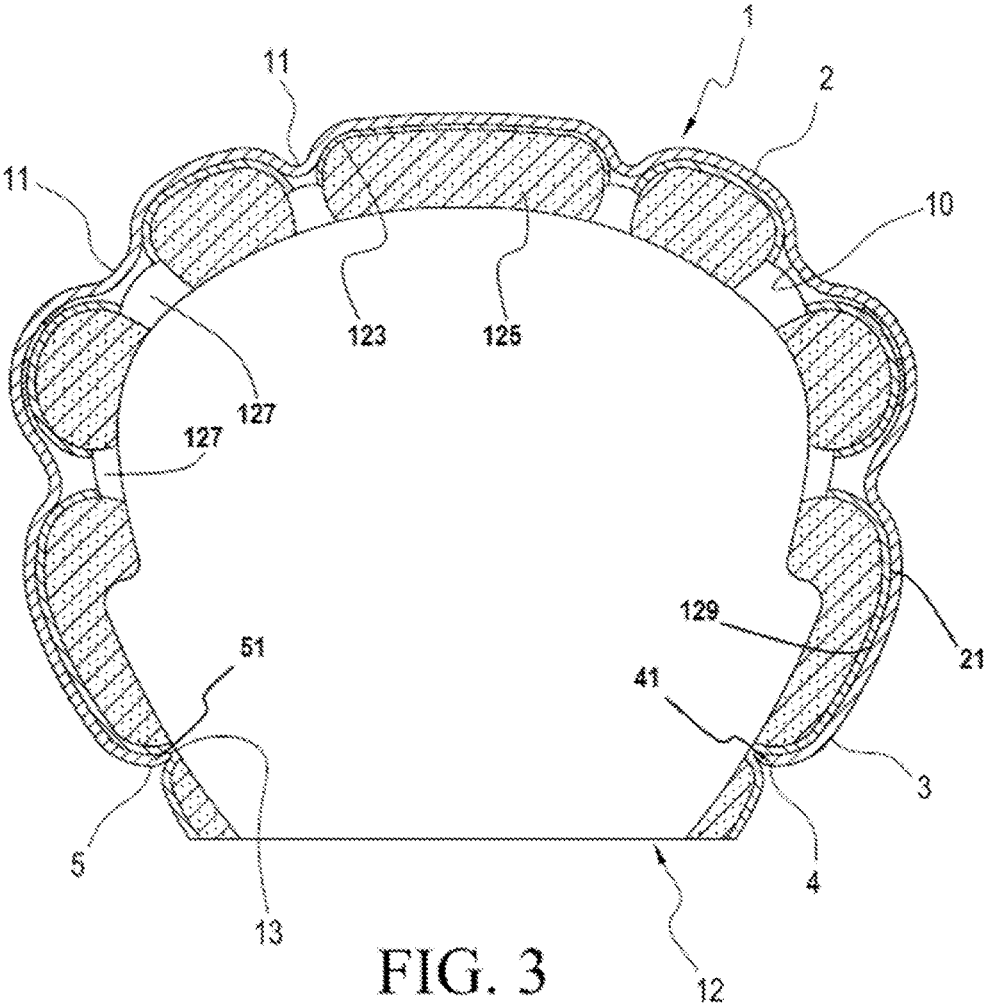
FIG. 3 represents a cross section according to line III-III in FIG. 1 helmet with a helmet cover according to the invention fixed thereto.
Figure 4:
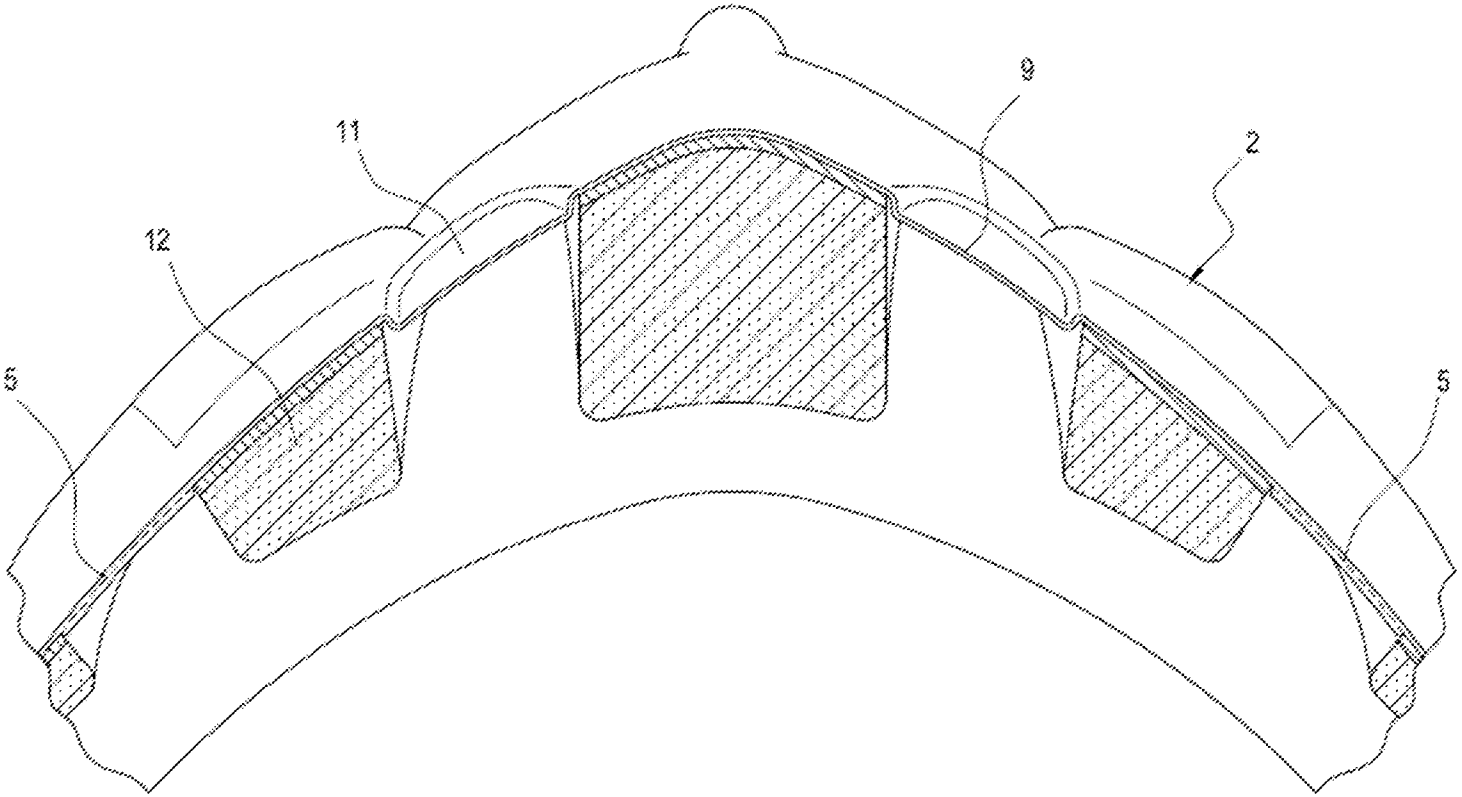
FIG. 4 represents another view of a helmet cover according to an embodiment.

In the represented embodiment and as represented in FIGS. 2 and 3, a helmet 12 may include an outer shell 123 and an inner base material 125, with the outer shell 123 overlying the inner base material 125. The engaging members each consist of a flange extending along the outer edge 3 and turned inwardly in view of the dome 2, the flange being an inwardly-extending flange defined by the most distal portion of the outer edge 41, 51, thereby creating a resilient snap fit lock to fix the cover 1 to a helmet as represented in FIG. 3.

The helmet cover is preferably manufactured in one single material, preferably a resin material and has a thickness of 1 mm or less. Examples of appropriate resin materials include vinyl chloride resins, acrylic resins, acetate resins, polycarbonate, polyethylene terephthalate (PET) and acrylonitrile-butadiene-styrene (ABS).

The helmet cover, including the engaging members, can be manufactured by molding a transparent vinyl chloride resin into a predetermined shape by means of a vacuum forming process so as to obtain a basic cover. This cover can subsequently be provided with a graphics layer by printing, coating or other suitable application techniques well known to a person skilled in the art, whereby the graphics are preferably applied at an inwardly faced surface 10 of the dome 2 and where after a protective and opaque layer is applied on the graphics layer at the inwardly directed surface 10 of the dome 2.

The outwardly facing surface of the dome 2 can be provided with a friction reducing layer to enhance aerodynamical behavior to the cover.

The cover 1 is shaped as a dome like structure and is formed such that an inwardly- faced surface 21 of the cover 1 corresponds in shape to an outer surface 129 of the outer shell 123 of helmet 12, with inwardly bulging wind splitting recesses 11 corresponding to wind splitting recesses, for example, at through-holes 127 in corresponding helmet 12, as shown in FIGS. 2 and 3. The provision of the wind splitting recesses not only ensures the wind splitting effect of the helmet cover when fixed to a helmet, but also increases mechanical strength of the helmet cover by virtue of a rib effect developed by the recesses 11.

As represented in FIG. 3, the cover 1 is fitted on the helmet 12 in a face contact fashion, wherein the inwardly facing surface 10 of the dome 2 is in contact with the outer surface of the helmet.

Clearly the helmet cover 1 closes at least a part of the through-holes provided in the helmet, thereby preventing entry of air, rain, sunlight radiation, etc. there through.

In a fixed position of the helmet cover on the helmet 12, the engaging members 4 and 5 are snap-fitted around an rim portion 13 of the helmet, thereby assuring fixation of the helmet cover and preventing wind to loosen the outer edge of the helmet cover 1 from the helmet.

According to the present embodiment, preferably at least a section of the outer edge along the front portion of the dome and a section of the outer edge along the rear portion of the dome are free of engaging members. These sections are an ideal grasping region for a user to remove the cover from the helmet. By providing such grasping region at both the front portion of the dome and the rear portion of the dome, a person can remove the helmet cover in a front to rear direction or in a back to front direction, depending on the circumstances. As such, when driving at high speed or in windy conditions, the person can remove the cover in a direction against the wind direction, thereby avoiding wind flowing under the cover and exerting great forces thereto in a loosening direction.

The cover can simply be mounted on the helmet by placing one engaging member in an engaging contact with a corresponding rim on the helmet and by subsequently pressing the cover on the helmet, thereby snap fitting the opposite engaging member behind a corresponding rim of the helmet. The snap fit action can be accompanied by an audible sound by carefully selecting the material and resiliency of the material of the helmet cover.

Since the cover is made of a resin material and is rather thin, it has flexibility and elasticity as a whole. Accordingly, the cover can be temporarily expanded so as to extend the distance between the engaging members at opposite edges of the cover to snap fit the cover on the helmet in a single movement. Once fitted over the helmet, the cover naturally resumes its original form, i.e., the edges return to their original positions engaging the rim of the helmet so that the cover is readily fixed to the helmet.

The engaging members and, optionally, wind splitting recesses 11 prevent the cover from displacement or shifting longitudinally or transversally in view of the helmet.

While the presently preferred embodiment of the present invention has been described in detail, as will be apparent with those familiar with the art, various variations and modifications can be made without departing from the scope of the present invention defined by the following claims.

The invention claimed is:

1. A removable helmet cover comprising: a dome with an outer edge; and at least two engaging members including a first engaging member and a second engaging member, wherein the engaging members are provided along an outermost portion of the outer edge of the dome, wherein each of the first engaging member and the second engaging member includes an inwardly-extending flange that extends inwardly to a center of the dome, the inwardly-extending flange being defined by the most distal portion of the outer edge of the dome, and wherein the first engaging member and the second engaging member are designed to cooperate with each other to releasably and repeatedly couple the helmet cover to a helmet by each of the first engaging member and the second engaging member engaging a corresponding rim portion of an outer shell of said helmet and fixing the helmet cover to the helmet by a resilient snap-fit lock, the outer shell of the helmet overlying an inner base material of the helmet, the outer shell of the helmet being a layer that is materially distinct and different from the inner base material of the helmet, and wherein the dome, the outer edge, the first engaging member, and the second engaging member of the helmet cover are manufactured of a single material to form said resilient snap-fit lock onto a dome shape of said helmet.

2. The removable helmet cover according to claim 1, wherein the at least two engaging members extend along opposite edges of the dome of said helmet cover.

3. The removable helmet cover according to claim 1, wherein the dome of said helmet cover comprises a front portion and a rear portion, and wherein at least a section of the outer edge of each of the front portion and the rear portion does not include engaging members.

4. The removable helmet cover according to claim 1, wherein each of said engaging members consists of the inwardly-extending flange extending inwardly to a center of the dome of said helmet cover.

5. The removable helmet cover according to claim 1, wherein said helmet cover is coated with a friction reducing layer.

6. The removable helmet cover according to claim 1, wherein graphics are applied on the dome of said helmet cover.

7. A helmet kit comprising:

a helmet that includes an outer shell and an inner base material, the outer shell overlying the inner base material, the outer shell of the helmet includes a layer that is materially distinct and different from the inner base material of the helmet, wherein the outer shell and the inner base material define through-holes that extend through the outer shell and the inner base material of the helmet; and a removable helmet cover designed to overly at least a portion of the outer shell of the helmet and cover one or more of said through-holes, the removable helmet cover having an inwardly-faced surface that corresponds in shape to an outer surface of the outer shell of said helmet, the helmet cover including a dome with an outer edge, wherein the helmet cover further includes at least two engaging members including a first engaging member and a second engaging member extending along an outermost portion of the outer edge of the dome, wherein each of the first engaging member and the second engaging member includes an inwardly-extending flange that extends inwardly to a center of the dome, the inwardly-extending flange being defined by the most distal portion of the outer edge of the dome, wherein the first engaging member and the second engaging member cooperate with each other to releasably and repeatedly couple the helmet cover to the helmet by each of the first engaging member and the second engaging member engaging a corresponding rim portion of said helmet and fixing the helmet cover to the helmet by a resilient snap-fit lock, and wherein the dome, the outer edge, the first engaging member, and the second engaging member of the helmet cover are manufactured of a single material to form said resilient snap-fit lock onto a dome shape of said helmet.

8. A removable helmet cover comprising: a dome designed to cover at least a portion of a surface of a helmet, the helmet including an outer shell that overlies an inner base material of the helmet, the outer shell of the helmet being a layer that is materially distinct and different from the inner base material of the helmet; a first engaging member designed to engage a first rim portion of the helmet, the first engaging member being located at a first outermost section of an outer edge of the dome; and a second engaging member designed to engage a second rim portion of the helmet, the second engaging member being located at a second outermost section of the outer edge of the dome, wherein each of the first engaging member and the second engaging member includes an inwardly-extending flange that extends inwardly to a center of the dome, each of the inwardly-extending flanges being defined by the most distal portion of the outer edge of the dome, wherein the first engaging member and the second engaging member are designed to cooperate with each other to releasably and repeatedly fix the helmet cover to the helmet by the first engaging member engaging the first rim portion of said helmet and the second engaging member engaging the second rim portion of said helmet and the first engaging member and the second engaging member fixing the helmet cover to the helmet by a resilient snap-fit lock, and wherein the dome, the outer edge, the first engaging member, and the second engaging member of the helmet cover are manufactured of a single material to form said resilient snap-fit lock onto a dome shape of said helmet.

9. The removable helmet cover according to claim 8, wherein the first section of the outer edge of the dome is opposite from the second section of the outer edge of the dome, the first engaging member being arranged opposite from the second engaging member along the outer edge of the dome of said helmet cover.

10. The removable helmet cover according to claim 8, wherein the dome of said helmet cover comprises a front portion and a rear portion, and at least a section of the outer edge of each of the front portion and the rear portion does not include engaging members.

11. The removable helmet cover according to claim 8, wherein the dome of said helmet cover defines a concavity, the first engaging member defines the first flange section that extends in a first inward direction of the concavity, and the second engaging member defines the second flange section that extends in a second inward direction of the concavity.

12. The removable helmet cover according to claim 8, wherein an outer surface of the dome of said helmet cover is coated with a friction reducing layer.

13. The removable helmet cover according to claim 8, further comprising a graphic applied on a surface the dome of said helmet cover.

14. The removable helmet cover according to claim 8 provided on a corresponding helmet.

15. The removable helmet cover according to claim 8, wherein the first engaging member is designed to engage said first portion of the helmet at a corresponding first rim portion of the helmet, and the second engaging member is designed to engage said second portion of the helmet at a corresponding second rim portion of the helmet.

16. The removable helmet cover according to claim 8, wherein the helmet cover is manufactured from a resin material.

* * * * *